US005455504A

United States Patent [19]

Suzuki et al.

[11] Patent Number: 5,455,504

[45] Date of Patent: Oct. 3, 1995

[54] CONSTANT-CURRENT CIRCUIT

[75] Inventors: Kozo Suzuki; Takashi Nagaiwa, both of Tsurugashima, Japan

[73] Assignee: Toko, Inc., Tokyo, Japan

[21] Appl. No.: 305,739

[22] Filed: Sep. 14, 1994

Related U.S. Application Data

[63] Continuation of Ser. No. 92,390, Jul. 14, 1993, abandoned.

[30] Foreign Application Priority Data

Jul. 17, 1992 [JP] Japan ..... 4-213354

[51] Int. Cl.[6] ..... G05F 3/28

[52] U.S. Cl. ..... 323/316; 323/907

[58] Field of Search ..... 323/907, 313, 323/314, 315, 316

[56] References Cited

U.S. PATENT DOCUMENTS

| | | | |
|---|---|---|---|
| 4,477,737 | 10/1984 | Ulmer et al. | 307/297 |
| 4,651,083 | 3/1987 | Lachmann et al. | 323/316 |
| 4,665,356 | 5/1987 | Pease | 323/314 |
| 4,853,610 | 8/1989 | Schade, Jr. | 323/316 |
| 4,887,181 | 12/1989 | Lenz | 361/103 |
| 4,985,820 | 1/1991 | Vorel | 363/49 |
| 5,223,743 | 6/1993 | Nakagawara | 307/296.1 |
| 5,241,261 | 8/1993 | Edwards et al. | 323/313 |

FOREIGN PATENT DOCUMENTS

| | | | |
|---|---|---|---|
| 0007118 | 1/1981 | Japan | 323/316 |

*Primary Examiner*—Kristine L. Kincaid
*Assistant Examiner*—Adolf Berhane

[57] ABSTRACT

A constant-current circuit is disclosed which is arranged such that the magnitude and temperature characteristic of a current flowing through a load can be set independently. Output side of a temperature characteristic setting circuit (15A) connected to a band-gap reference circuit (14), and output side of voltage-follower circuit (16) are connected to a control resistor (R12). The temperature characteristic of the current I0 flowing through the load (13) is set by the band-gap reference circuit (14) and temperature characteristic setting circuit (15A), and the magnitude of the current I0 is set by the control resistor (R12). The arrangement is made such that the magnitude and temperature characteristic of the current I0 can be set independently; thus, the circuit design can be simplified and the the magnitude and temperature characteristic of the current can be set with a high accuracy.

3 Claims, 3 Drawing Sheets

CONSTANT-CURRENT CIRCUIT

This application is a continuation of application Ser. No. 08/092,390, filed Jul. 14, 1993 now abandoned.

BACKGROUND OF THE INVENTION

1. Field of the Invention

The present invention relates to a temperature compensated type constant-current circuit which is designed to cause the magnitude of a current supplied to a load circuit to be increased or decreased with respect to temperature variation so float a current representing a negative temperature characteristic ls supplied to a load which is likely to be subjected to thermorunaway as a result of current flowing in the circuit being increased with temperature rise as in a power device, for example. More particularly, the present invention pertains to such a constant-current circuit arranged such that the magnitude and temperature charatersitic of the current flowing through the load can readily be set.

2. Description of the Prior Art

Referring to FIG. 1 of the accompanying drawings, there is shown an example of conventional constant-current circuit which is arranged such that current is changed depending on the temperature coefficient of the circuit.

In the illustrated constant-current circuit, a voltage-follower circuit 56 is connected to the output terminal of a temperature characteristic setting circuit 55 coupled to a band-gap reference circuit 54, the output terminal of the voltage-follower circuit 56 being connected to a control resistor R52 which is connected in series with a load 53.

The band-gap reference 54 is a bias circuit which utilizes band-gap potential of a semiconductor and comprises a first PNP type transistor Q51, second PNP type transistor Q52, third NPN type transistor Q53, fourth NPN type transistor Q54, and resistor R51.

Connected in parallel between input terminals 57*a* and 57*a* are a series circuit wherein the collector of the first transistor Q51 and that of the third transistor Q53 are connected to each other and the resistor R51 is coupled to the emitter of the third transistor Q53, and another series circuit wherein the collector of the second transistor Q52 is connected to that of the fourth transistor Q54.

The base of the first transistor Q51 and that of the second transistor Q52 are connected to each other, and further the first transistor Q51 has its base connected to its collector. The base of the third transistor Q53 and that of the fourth transistor Q54 are also connected to each other, and the fourth transistor Q54 has its base connected to its collector.

The temperature characteristic setting circuit 55 is a circuit which is arranged to set up the state in which the current derived from the constant-current circuit is changed with temperature, i.e., temperature characteristic in accordance with variations in the current with temperature variations in the band-gap reference circuit 54. This circuit comprises a fifth PNP type transistor Q55, switch SW 51, resistor R54, and diode D51. The fifth transistor Q55 has its emitter connected to the input terminal 57*a*, and it has also its base coupled to the bases of the first and second transistors Q51 and Q52 of the band-gap reference circuit 54, thus constituting a current mirror circuit. The collector of the fifth transistor Q55 is connected to a movable contact of a change-over switch SW51, and the resistor R54 and diode D51 are connected to a first and a second fixed contact of the switch SW51, respectively. The other terminals of the resistor R54 and diode D51 are coupled to the input terminal 57*b*.

The voltage-follower circuit 56 is arranged to keep constant the constant voltage across the control resistor R52. More specifically, the circuit 56 comprises an amplifier 52 having an inverting input terminal, a non-inverting input terminal, and an output terminal, wherein the non-inverting input terminal is connected to the output terminal; the output terminal is connected to the control resistor R52; and the non-inverting input terminal is connected to the collector of the fifth transistor Q55 of the temperature characteristic setting circuit 55.

In FIG. 1, V1 is a voltage which occurs at the collector of the fifth transistor Q55 of the temperature characteristic setting circuit 55 and is inputted to the voltage-follower circuit 56; I0 is a current which flows through the load 53 connected across the output terminals 58*a* and 58*b*; and I1 is a current which flows in the temperature characteristic setting circuit 55.

Description will first be made of circuit operation which is performed in the ease where the change-over switch SW5 of the temperature characteristic setting circuit 55 is connected to the resistor R51 side.

Current flowing through the second transistor Q52 and that flowing through the fifth transistor Q55 become equal to each other because of the fact that the first and second transistors Q51 and Q52 of the band-gap reference circuit 54 and the fifth transistor Q55 of the temperature characteristic setting circuit 55 constitute a current mirror circuit. Thus, the current I1 flowing through the fifth transistor Q55 of the temperature characteristic setting circuit 55 can be sought from the current flowing in the band-gap reference circuit 54 in accordance with the following equation:

$$I1=(VT/Ra)\ \ln N \tag{1}$$

where Ra is the resistance value for the resistor R51, and N is the ratio of the emitter area of the third transistor Q53 to that of the fourth transistor Q54. VT is termed thermo-voltage which is a constant given in accordance with the following equation:

$$VT=KT/q \tag{2}$$

where K is Boltzmann's constant, T is absolute temperature, q is charge mass. The thermo-voltage VT is approximately 26 mV at 27° C.

As will be seen from the above equations (1) and (2), the current I1 includes as a proportional term the thermo-voltage VT having a positive temperature coefficient, and thus it represents positive temperature characteristic. Since the current I1 representing positive temperature characteristic is caused to flow through the resistor R54, the voltage V1 which also represents positive temperature characteristic is applied to the control resistor R52 through the voltage-follower circuit 56. Since the control resistor R52 is connected in series with the load 53, the current I0 flowing through the latter depends on the control resistor R52 and voltage V1 and thus represents positive temperature characteristic.

Circuit operation performed when the change-over switch SW51 of the temperature characteristic setting circuit 55 is connected to the diode D51 side is the same as that when the switch SW51 is connected to the resistor R54 side, in so far as the current I1 represents positive temperature characteristic. Generally, a diode element represents resistance having negative temperature characteristics. If the positive temperature coefficient of the thermo-voltage VT included in the current I1 given by the equations (1) and (2) is greater than the negative temperature coefficient of the resistance of the diode D51, then the voltage V1 turns out to represent negative temperature characteristic. Thus, the current I0 flowing through the load 53 represents negative temperature characteristic.

As will be appreciated from the above discussion, with the conventional constant-current circuit shown in FIG. 1, it is possible to select and set up the temperature characteristic of the current flowing through a load connected thereto, in conformity to the characteristic of the load. However, the temperature characteristic and magnitude of the current I0 is determined by the voltage V1 derived from the temperature characteristic setting circuit 55, and the control resistor R52. Thus, the conventional circuit of FIG. 1 is disadvantageous in that the magnitude and temperature characteristic of the I0 cannot be set up independently so that troublesomeness is experienced in designing the circuit to achieve desired current value and temperature characteristic, and the accuracy with which the current value and temperature characteristic can be set up, is limited.

SUMMARY OF THE INVENTION

The present invention has been made in view of the above-mentioned problems with the prior art, and it ls an object of the present invention to provide a constant-current circuit which is arranged such that the magnitude and temperature characteristic of a current flowing through a load can be set up independently, circuit design can be simplified, and the magnitude and temperature characteristic of the current can be set up with an enhanced accuracy.

Briefly stated, according to the present invention, the output terminal of a temperature characteristic setting circuit connected to a band-gap reference circuit, and the output terminal of a voltage-follower circuit are connected to a control resistor so that the temperature characteristic of the current flowing through the load is set up on the basis of an output current from the temperature characteristic setting circuit, thereby making it possible to set up, on the basis of the resistance value for the control resistor, the magnitude of the current flowing through the load.

DESCRIPTION OF THE PREFERRED EMBODIMENTS

Figure 2:
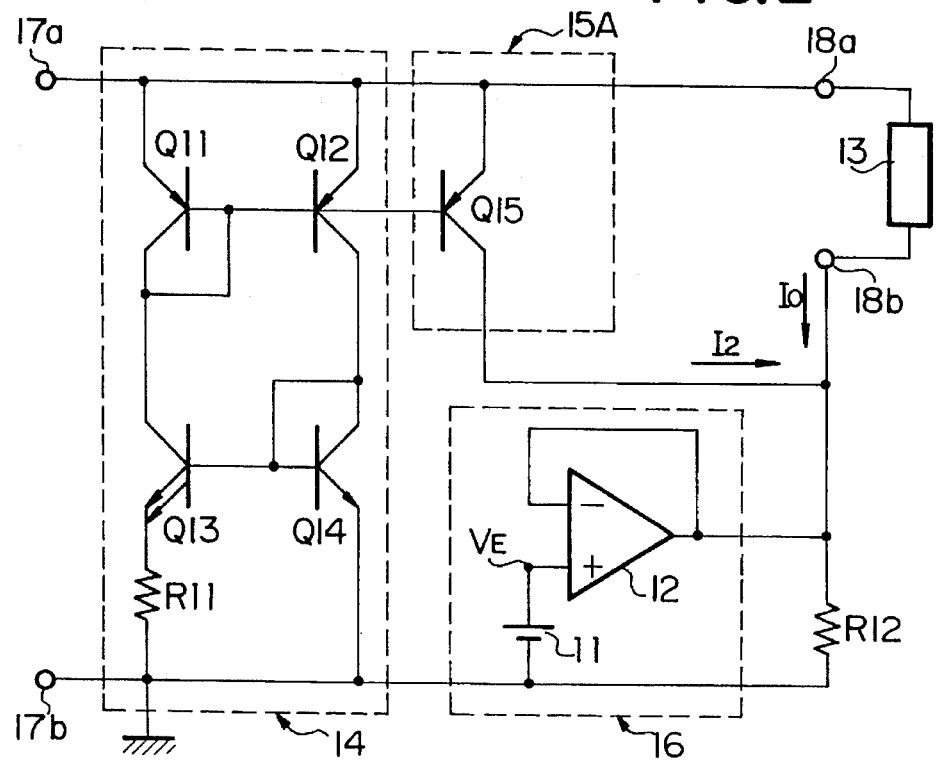
FIG. 2 is a circuit diagram showing the constant-current circuit according to an embodiment of the present invention.

Referring to FIG. 2, there is shown the constant-current circuit according to an embodiment of the present invention, wherein the output terminal of a temperature characteristic setting circuit 15A connected to a band-gap reference circuit 14 is coupled to the output terminal of a voltage-follower circuit 16, and the output terminal of voltage-follower circuit 16 is also connected to a control resistor R12 which is connected in series with a load 13.

Figure 1:
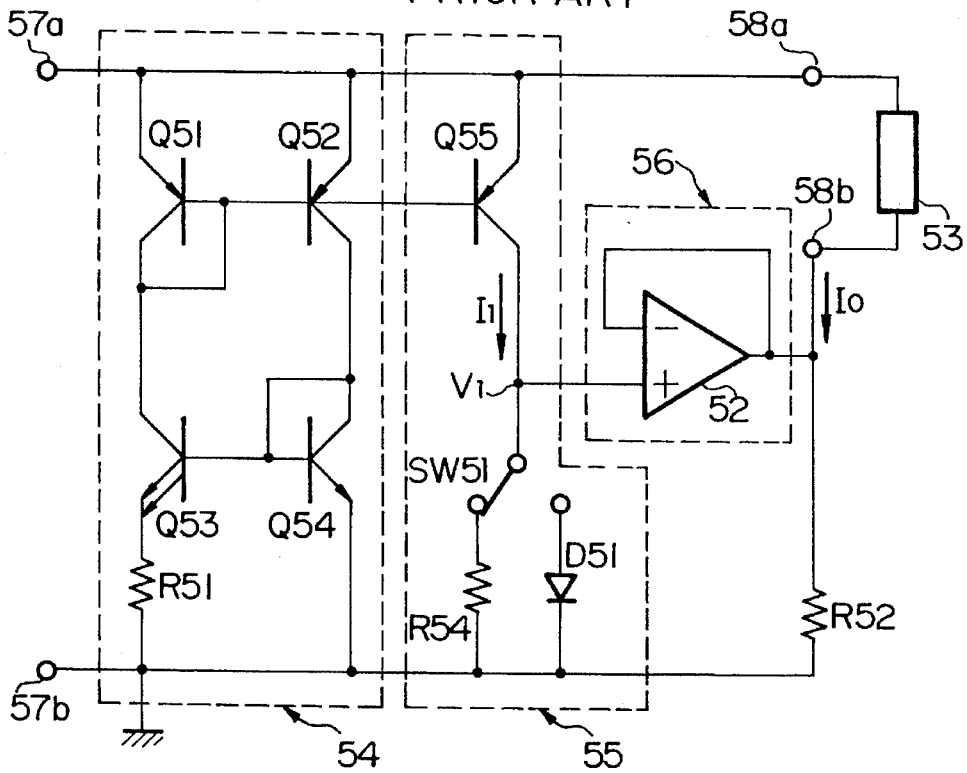
FIG.1 PRIOR ART
FIG. 1 is a circuit diagram showing a conventional constant-current circuit.

The band-gap reference circuit 14 comprises a first and a second PNP type transistor Q11 and Q12, a third and a fourth NPN type transistor Q13 and Q14, and a resistor R11, and is similar to the band-gap reference circuit 54 of FIG. 1 in terms or circuit connection arrangement.

The temperature characteristic setting circuit 15A comprises a fifth PNP type transistor Q15 having its emitter connected to an input terminal 17*a*, the base of the fifth transistor Q15 being connected to the bases of the first and second transistors Q11 and Q12 of the band-gap reference circuit 14, thus constituting a current mirror circuit, wherein the collector of the fifth transistor Q15 is connected to the output terminal of the voltage-follower circuit 16 and the control resistor R12.

The voltage-follower circuit 16 comprises an amplifier 12, which has a non-inverting input terminal, an inverting input terminal and an output terminal, and a reference voltage source 11. The non-inverting input terminal of the amplifier 12 is connected to the higher potential side terminal of the reference voltage source 11; the inverting input terminal and output terminal are connected to each other; the output terminal is further connected to the output terminal of the temperature characteristic setting circuit 15A and the control resistor R12; and the lower potential side terminal of the reference voltage source 11 is connected to an input terminal 17*b*.

In FIG. 2, VE is the voltage of the reference voltage source; I2 is a current derived from the temperature characteristic setting circuit 15A; and I0 is a current which flows through the load 13.

The fifth transistor Q15 of the temperature characteristic setting circuit 15A constitutes a current mirror circuit with the first and second transistors Q11 and Q12 of the band-gap reference circuit 14. Thus, a current I2 derived from the temperature characteristic setting circuit 15A is given as follows, by substituting the resistance value Ra of the resistor R51 with the resistance value Rb of the resistor R11 in the aforementioned equation (1):

$$I2=(VT/Rb)\ \ln N \quad (3)$$

The current I2 represents a positive temperature characteristic. In the equation (3), N is the ratio of the emitter area of the third transistor Q13 to that of the fourth transistor Q14.

A voltage equal to VE is normally applied across the control resistor R12 by virtue of the fact that the voltage VE derived from the reference voltage source 11 is applied to the non-inverting input terminal of the amplifier 12 of the voltage-follower circuit 16. 0n the assumption that the resistance value of the control resistor R12 is Rc therefore, the current which flows through the control resistor R12 is given by (VE/Rc) and always turns out to be invariable with a temperature change. Further, this current is a sum of the current I0 flowing through the load 13 and the output current I2 of the temperature characteristic setting circuit 15A and given by the following equation:

$$I0=(VE/Rc)-I2 \quad (4)$$

The current I2 represents a positive temperature characteristic as mentioned above; thus, it is seen from the above equation that the current I0 represents a negative temperature characteristic.

Figure 3:
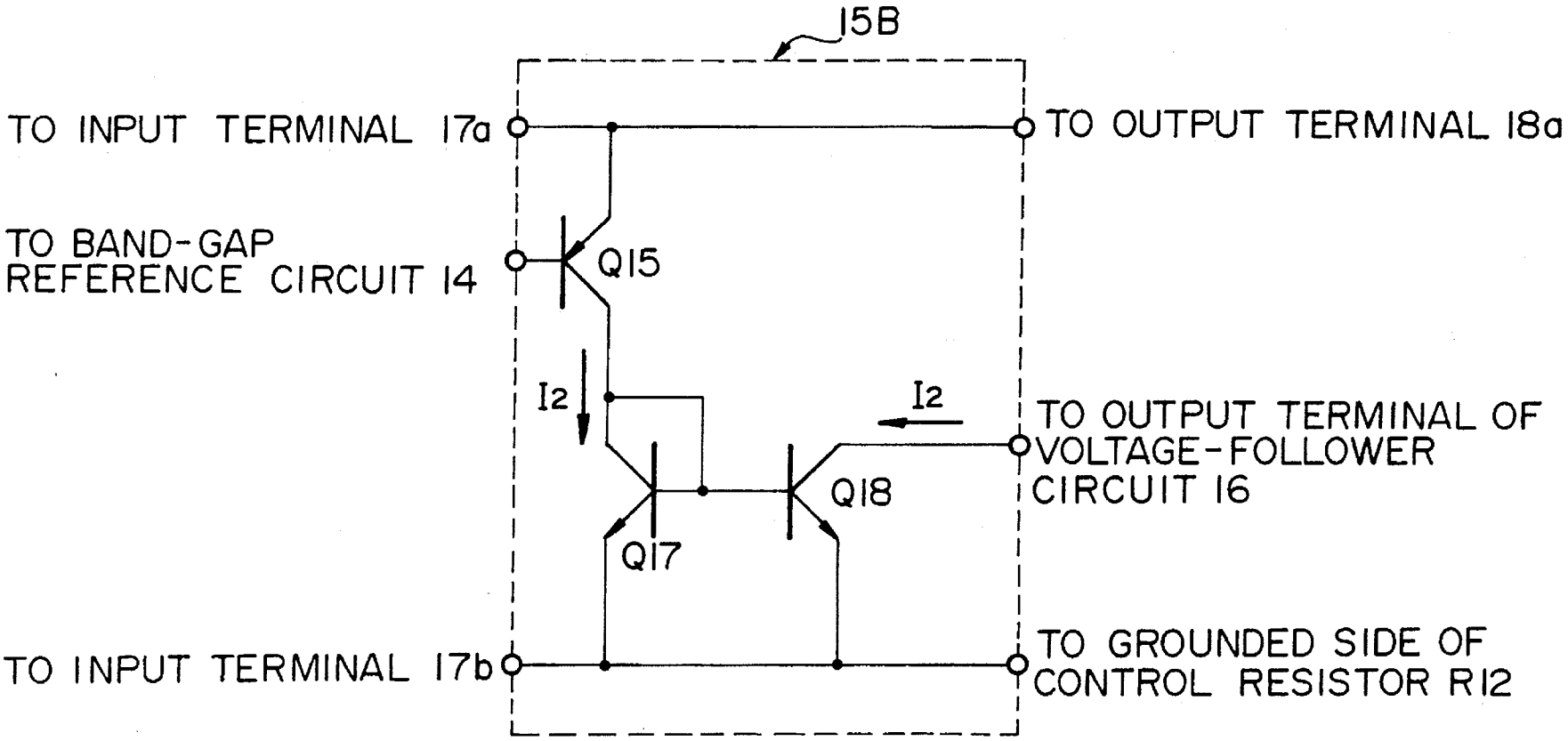
FIG. 3 is a circuit diagram showing another temperature characteristic setting circuit which may be incorporated in the constant-current circuit of FIG. 2.

With the constant-current circuit arrangement described above in conjunction with FIG. 2, the current I0 flowing through the load 13 represents a negative temperature characteristic. In the case where it is required that the current I0 represents a positive temperature characteristic, the circuit arrangement of the temperature characteristic setting circuit 15A may be modified to be as shown at 15B in FIG. 3.

More specifically, a seventh NPN type transistor Q17 is provided which has its collector connected to the collector of the fifth transistor Q15 constituting the current mirror circuit with the first and second transistors Q11 and Q12 of the band-gap reference circuit 14. The emitter of the seventh transistor Q17 is connected to the input terminal 17*b*, and the base and collector thereof are connected together. Further, there is provided an eighth transistor Q18 which has its base coupled to that of the seventh transistor Q17. Thus, a current mirror circuit is constituted by the seventh transistor Q17 and eighth transistor Q18. The emitter of the eighth transistor Q18 is connected to the input terminal 17*b*, and the collector thereof is coupled to the output terminal of the voltage-follower circuit 16.

By using, in place of the temperature characteristic setting circuit 15A, the above-mentioned temperature characteristic setting circuit 15B, the current I2 given by the equation (3) is caused to flow through the seventh and eighth transistors Q17 and Q18. Because of the eighth transistor Q18 and control resistor R12 being connected in parallel with each other, the current I0 flowing through the load 13 turns out to be a sum of current which always remains unchanged with the aid of the voltage-follower circuit 16 and control resistor R12 and current which flows through the eighth transistor Q18, and it can be expressed by the following equation:

$$I0=(VE/Rc)+I2 \quad (5)$$

The current I2 in the equation (5) represents a positive temperature characteristic as explained above in conjunction with the equation (3); thus, the current I0 flowing through the load 13 also represents a positive temperature characteristic.

The temperature characteristic of the current I2 is determined by the temperature characteristic of the band-gap reference circuit 14, and the temperature characteristic setting circuit 15A; thus, the current I0 flowing through the load 13 depends on the temperature characteristics of the band-gap reference circuit 14 and temperature characteristic setting circuit 15A.

Further, the magnitude of the current I2 is determined by the band-gap reference circuit 14, and the current flowing through the control resistor R12 is readily determined from the output voltage VE of the reference voltage source 11 and the resistance value of the control resistor R12. Thus, the magnitude of the current I0 flowing through the load can readily be determined by the control resistor R12 without being influenced by the temperature characteristic setting of the temperature characteristic setting circuit 15A.

Figure 4:
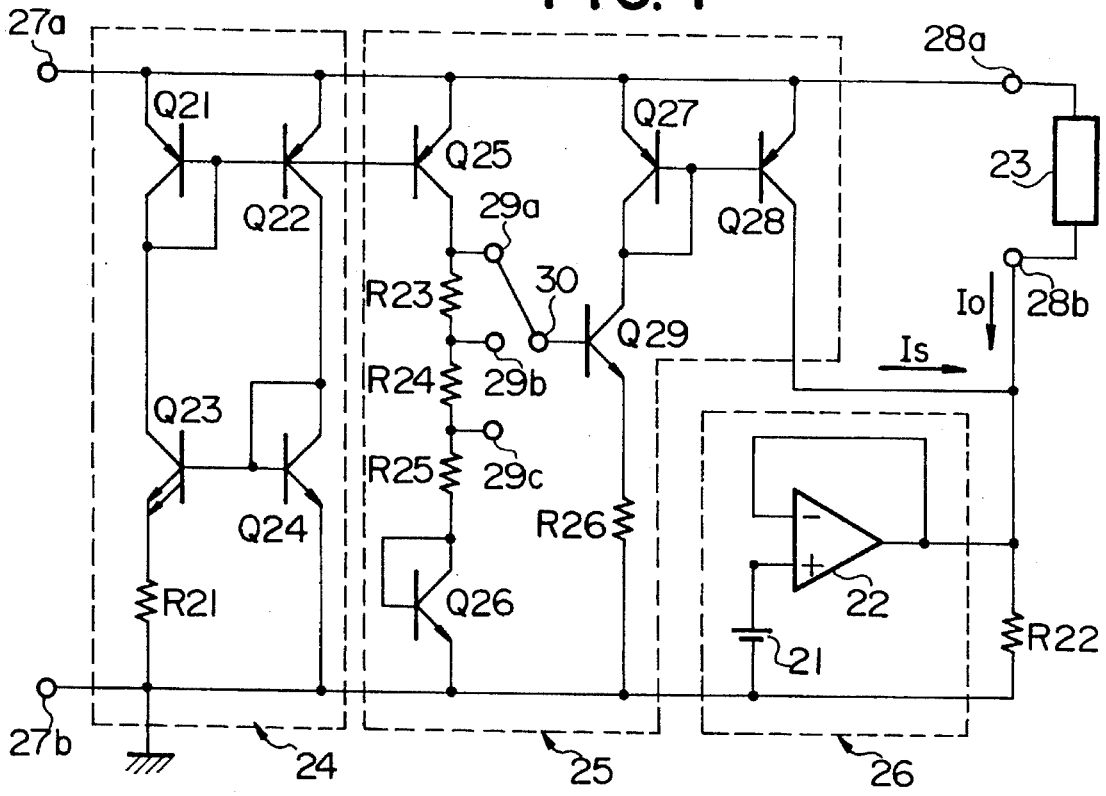
FIG. 4 is a circuit diagram showing the constant-current circuit according to another embodiment of the present invention.

Referring to FIG. 4, there is shown the constant-current circuit according to a second embodiment of the present invention, which is similar to the constant-current circuit of FIG. 2 in terms of elements and circuit arrangement expect for the circuit arrangement of temperature characteristic setting circuit 25.

The temperature characteristic setting circuit 25 comprises a fifth, a seventh and an eighth transistor Q25, Q27 and Q28 which are of the PNP type; a sixth and a ninth transistor Q26 and Q29 which are of the NPN type; resistors R23 to R26; led-out terminals 29*a*, 29*b* and 29*c*; and a connection terminal 30.

The resistors R23, R24 and R25 are connected in series with each other between the collectors of the fifth and sixth transistors Q25 and Q26, and each of the led-out terminals 29*a*, 29*b* and 29*c* is led out of a respective end of each of these resistors. The emitter of the fifth transistor Q25 is connected to the input terminal 27*a*, the base thereof being coupled to the bases of the first and second transistors Q21 and Q22 of the band-gap reference circuit 24; and the first and second transistors Q21 and Q22 of the band-gap reference circuit 24, and the fifth transistor Q25 are connected with each other in such a manner as to constitute a current mirror circuit. The sixth transistor Q26 has its emitter connected to the input terminal 27*b*, the base and collector thereof being connected together so as to equivalently form a diode.

The seventh and eighth PNP type transistors Q27 and Q28 have their bases connected together so as to constitute a current mirror circuit, the emitters of the seventh and eighth transistors Q27 and Q28 being connected to the input terminal 27*a*. The collector of the eighth transistor Q28 is connected to the output terminal of the voltage-follower circuit 26 as the output terminal of the temperature characteristic setting circuit 25. The seventh transistor Q27 has its base and collector connected together, the collector thereof being coupled to that of the ninth transistor Q29.

The ninth transistor Q29 is connected to the input 27*b* through emitter resistor R26 and provided at its base with a connection terminal 30, which is selectively connectable to any one of the terminals 29*a*, 29*b* and 29*c* led out of the respective ends of the resistors R23, R24 and R25.

The operation of the above-described circuit arrangement will be explained below.

A current corresponding to the current I1 given by the above equation (1) is caused to flow through the fifth transistor Q25 connected to the band-gap reference circuit 24. Consequently, voltages equal to the resistance values of the resistors R23, R24, R25 and sixth transistor Q26 which are connected in series with each other with respect to the input terminal 27*b*, multiplied by the magnitude of current flowing through the fifth transistor Q25, are caused to appear at the led-out terminals 29*a*, 29*b* and 29*c*, respectively.

The ninth transistor Q29 is driven by the voltage appearing at that one of the terminals 29*a*, 29*b* and 29*c* which is connected to the connection terminal 30; as a result, a current is caused to flow through the series circuit of the seventh and ninth transistors Q27 and Q29 and control resistor R26 so that current I3 is caused to flow through the eighth transistor Q28 which constitutes a current mirror circuit with the seventh transistor Q27.

The current flowing through the fifth transistor Q25 represents a positive temperature characteristic as shown by the equation (1) or (3), and the resistance value of the sixth transistor Q26, which constitutes a diode on an equivalent basis, represents a negative resistance-temperature characteristic. The temperature characteristics of the voltages appearing at the terminals 29*a*, 29*b* and 29*c* are set up by the resistors R23, R24 and R25 respectively, so that the temperature characteristic of the voltage appearing at the terminal 29*a* is influenced especially by the positive temperature characteristic of the current flowing through the fifth transistor Q25 and the temperature characteristic of the voltage appearing at the terminal 29*c* is affected especially by the negative temperature characteristic of the resistance value of the sixth transistor Q26.

In this way, according to the present invention, the temperature characteristic of the voltage appearing at each of the terminals 29*a*, 29*b* and 29*c* can be set up in various ways. More specifically, depending on resistance values set up for the resistors R23, R24 and R25, it is possible that voltages appearing at the three terminals, i.e., terminals 29*a*, 29*b* and 29*c* may represent positive or negative temperature characteristics having different temperature coefficients; it is possible that the voltage appearing at the terminal 29*a* represents a positive temperature characteristic, that the voltage appearing at the terminal 29*b* may be independent of temperature, and that the voltage appearing at the terminal 29*c* may represent a negative temperature characteristic; and so on.

For example, by setting up the values for the resistors R23, R24 and R25 such that the voltage appearing at any one of the terminals 29*a*, 29*b* and 29*c* does not depend on temperature and remains unchanged, and by connecting the terminal providing the voltage which does not depend on temperature to the non-inverting terminal of the amplifier 22 of the voltage-follower circuit 26, it is possible that the reference voltage source 21 may be eliminated.

While in FIG. 4, the resistors connected between the collectors of the fifth and sixth transistors Q25 and Q26 have been illustrated as comprising the three resistors, i.e., the resistors R23. R24 and R25, it is to be understood that no limitation is laid on the number of such resistors. Further, although the resistors R23, R24 and R25 have been shown as fixed resistors, it is also to be understood that variable resistors may be employed instead of the fixed ones.

The temperature characteristic which the output current I3 derived from the temperature characteristic setting circuit 25 represents, depends on the voltage which appears at any one of the terminals 29*a*, 29*b* and 29*c*.

The current flowing through the control resistor R22 remains unchanged all the time under the action of the voltage-follower circuit 26, and the magnitude of the current turns out to be equal to a sum of the current I0 flowing through the load 23 and the output current I3 derived from the temperature characteristic setting circuit 25. Thus, the current I0 flowing through the load 23 represents a negative temperature characteristic when the current I3 represents a positive temperature characteristic, whereas when the current I3 represents a negative temperature characteristic, the current I0 flowing through the load 23 represents a positive temperature characteristic. This is apparent from the equation (4) relative to FIG. 2.

Since the temperature characteristic of the current I3 is determined by the temperature coefficients of the band-gap reference circuit 24 and temperature characteristic setting circuit 25, the current I0 flowing through the load 23 depends on the temperature characteristics of the band-gap reference circuit 24 and temperature characteristic setting circuit 25. The magnitude of the current I3 is determined by the band-gap reference circuit 24 and temperature characteristic setting circuit 25, and can be varied to some extent in dependence on the setting of the temperature characteristics. The effect of variations in the magnitude of the current I3 on the current I0 can be compensated for by means of the control resistor R22, and the current flowing through the control resistor R22 can readily be determined from the output voltage of the reference voltage source 21 and the resistance value of the control resistor R22. Thus, it is possible to set up the magnitude of the current I0 flowing through the load 23, with the aid of the control resistor R22.

Figure 5:
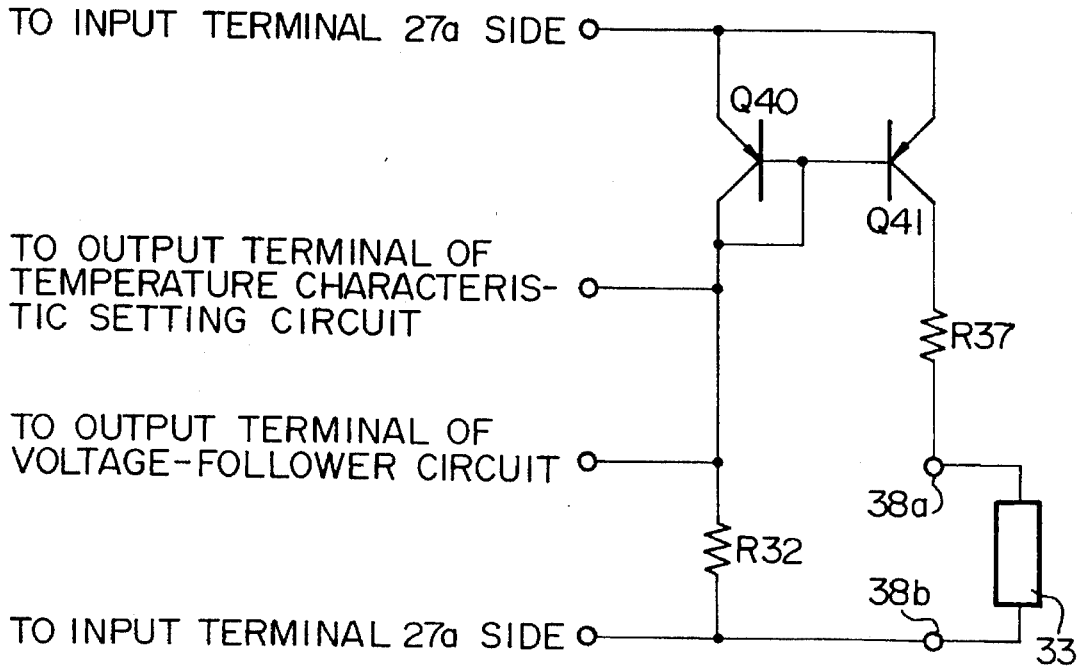
FIG. 5 is a circuit diagram showing the output side portion of the present constant-current circuit with a load being grounded.

The embodiments of the present invention have been illustrated and described with respect to circuit arrangement wherein the load and control resistor are connected in series with each other; with such circuit arrangement, there is a tendency that the potential at the load builds up. In the case where it is desired to avoid such build-up of the potential, use may be made of such a circuit arrangement as shown in FIG. 5 wherein a PNP type transistor Q40 is provided between a control resistor 32 and the input terminal 27*a*; the collector of the transistor Q40 is connected to the control resistor R32; the base and collector of the transistor Q40 are connected together; a further PNP type transistor Q41 is provided which has its emitter and base connected to the emitter and base of the transistor Q40 respectively so as to form a current mirror circuit; and an output terminal 38*a* is connected to the collector of the transistor Q41 through a protective resistor R37. Another output terminal 38*b* is coupled to the input terminal 27*b*, and a load is connected between the output terminals 38*a* and 38*b*.

In FIG. 5, the circuit portion provided at the input terminal side as viewed from the control resistor R32 is omitted just for the sake of simplicity.

A current corresponding to the above-mentioned current I0 is caused to flow through the transistor Q40; thus, current corresponding to the current I0 is also caused to flow through the load 33 via the transistor Q41 which constitutes current mirror circuit with the transistor Q40.

While in the above discussion of the embodiments of the present invention, the band-gap reference circuit has been illustrated and explained as comprising the first to fourth transistors, it is to be understood that the present invention is by no means limited thereto and can employ any type of bias circuit utilizing band-gap voltage.

Although in the foregoing discussion, description has been made of the case where transistor having its collector and base connected together is used as element representing a negative resistance-temperature characteristic, the present invention is not limited thereto in any way and it can use any other element such, for example, as diode or the like in so far as it represents a negative temperature characteristic.

We claim:

1. A temperature compensated type constant-current circuit, comprising:

a band-gap reference circuit which is a bias circuit utilizing a band-gap voltage of semiconductor:

a temperature characteristic setting circuit to which is inputted a current which is derived from said band-gap reference circuit and varies with a temperature variation;

a voltage-follower circuit; and a control resistor arranged such that a voltage thereacross is maintained to be constant by said voltage-follower circuit, wherein an output side of said temperature characteristic setting circuit is connected to said control resistor so that a current corresponding to a sum of or difference between an output current flowing through load connected in series with said control resistor and current available at the output side of said temperature characteristic setting circuit is caused to flow through said control resistor and magnitude of said output current is set by said control resistor.

2. A constant-current circuit according to claim 1, wherein the current available at the output side of said temperature characteristic setting circuit represents a positive temperature characteristic with respect to a temperature variation as is the case with a current of said band-gap reference circuit.

3. A constant-current circuit according to claim 1, wherein said temperature characteristic setting circuit comprises a transistor element providing a current which represents a positive temperature characteristic as is the case with variations in the current of said band-gap reference circuit, and an element having a resistance which represents a negative temperature characteristic, said transistor element and said element being connected to each other through a single resistor or a plurality of resistors connected in series with each other, wherein a temperature characteristic of a current available at the output side of said temperature characteristic setting circuit is set with a voltage terminal led out of said resistor or resistors.

* * * * *